US009592679B2

(12) United States Patent
Washizawa et al.

(10) Patent No.: US 9,592,679 B2
(45) Date of Patent: Mar. 14, 2017

(54) LIQUID EJECTING APPARATUS AND LIQUID EJECTING METHOD

(71) Applicant: SEIKO EPSON CORPORATION, Tokyo (JP)

(72) Inventors: Takehito Washizawa, Shiojiri (JP); Yoshiyuki Konishi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/860,094

(22) Filed: Sep. 21, 2015

(65) Prior Publication Data

US 2016/0082737 A1 Mar. 24, 2016

(30) Foreign Application Priority Data

Sep. 24, 2014 (JP) ..... 2014-193417

(51) Int. Cl.

| | |
|---|---|
| ***B41J 29/38*** | (2006.01) |
| ***B41J 2/085*** | (2006.01) |
| ***B41J 2/41*** | (2006.01) |
| ***B41J 11/00*** | (2006.01) |

(52) U.S. Cl.

CPC ..... *B41J 11/0015* (2013.01); *B41J 29/38* (2013.01)

(58) Field of Classification Search

CPC ..... B41J 2/08; B41J 2/085; B41J 2/09; B41J 2/095; B41J 2/41; B41J 2/04516; B41J 11/0015; B41J 29/38

See application file for complete search history.

(56) References Cited

U.S. PATENT DOCUMENTS

| | | | | |
|---|---|---|---|---|
| 5,774,141 | A * | 6/1998 | Cooper | B41J 2/1714 347/34 |
| 2007/0252874 | A1* | 11/2007 | Duby | B41J 2/14 347/67 |
| 2008/0012924 | A1* | 1/2008 | Moriyama | B41J 2/04 347/112 |
| 2008/0246803 | A1* | 10/2008 | Barger | B41J 2/1752 347/34 |
| 2013/0215194 | A1* | 8/2013 | Leoni | B41J 2/1652 347/34 |

FOREIGN PATENT DOCUMENTS

| | | |
|---|---|---|
| JP | 2006-027156 A | 2/2006 |
| JP | 2007-144791 A | 6/2007 |
| JP | 2013-107330 A | 6/2013 |
| JP | 2015-024648 A | 2/2015 |
| JP | 2015-024649 A | 2/2015 |

* cited by examiner

*Primary Examiner* — Geoffrey Mruk
*Assistant Examiner* — Scott A Richmond
(74) *Attorney, Agent, or Firm* — Workman Nydegger

(57) ABSTRACT

A liquid ejecting apparatus includes a transport unit that transports a medium; an ejecting portion that is provided to a mobile portion that is movable in a crossing direction intersecting a transport direction in which the medium is transported by the transport unit, and ejects liquid onto the medium transported by the transport unit; a first neutralizer that is provided to the mobile portion and neutralizes the liquid; and a second neutralizer that is provided to the mobile portion and neutralizes the medium.

7 Claims, 9 Drawing Sheets

LIQUID EJECTING APPARATUS AND LIQUID EJECTING METHOD

BACKGROUND

1. Technical Field

The present invention relates to a liquid ejecting apparatus and a liquid ejecting method.

2. Related Art

Liquid ejecting apparatuses having a transport unit for transporting a medium have been used. In such liquid ejecting apparatuses, the medium may be charged due to separating charges and the like in the transport unit transporting the medium. Thus, for example, JP-A-2013-107330 discloses a liquid ejecting apparatus (a recording apparatus) provided with an ionizer for neutralizing a charged medium.

In the liquid ejecting apparatus disclosed in JP-A-2013-107330 that is configured to neutralize a medium, however, it may be difficult to effectively neutralize the entire medium having a large width. Thus, charged liquid such as ink mist may be attached to an insufficiently neutralized portion on the medium, causing contamination of the portion. Further, providing a neutralizer having a length corresponding to the entire width of the wide medium in order to neutralize the medium may result in the apparatus having a complicated structure and an increase in the size and cost of the apparatus. Further, for example, due to charging of the medium to one of the positive polarity and the negative polarity by using the ionizer and the like, a support portion supporting the medium may be charged to the other polarity, and thereby the medium may become attached to the support portion by Coulomb force resulting in transport failure of the medium.

It is therefore required that liquid ejected from an ejecting portion be neutralized with a simple configuration, and transport failure of a medium due to the neutralization of the liquid be suppressed.

SUMMARY

An advantage of some aspects of the invention is that a simple configuration for neutralizing liquid ejected from an ejecting portion can be provided and transport failure of a medium due to the neutralization of the liquid can be suppressed.

According to an aspect of the invention, a liquid ejecting apparatus includes: a transport unit that transports a medium; an ejecting portion that is provided to a mobile portion that is movable in a crossing direction intersecting a transport direction in which the medium is transported by the transport unit, and ejects liquid onto the medium transported by the transport unit; a first neutralizer that is provided to the mobile portion and neutralizes the liquid; and a second neutralizer that is provided to the mobile portion and neutralizes the medium.

It is preferable that the first neutralizer be an ion generator that generates positive ions or negative ions, and the second neutralizer be an ion generator that generates ions having an opposite polarity to the ions generated by the first neutralizer.

It is preferable that the first neutralizer be provided upstream of the second neutralizer in the transport direction of the medium.

It is preferable that a distance between the first neutralizer and the second neutralizer be longer than or equal to 40 mm and shorter than or equal to 200 mm.

It is preferable that the first neutralizer be provided upstream of the ejecting portion within a range of 40 mm to 80 mm from the ejecting portion in an ejecting direction in which the liquid is ejected by the ejecting portion.

It is preferable that the second neutralizer be provided upstream of or at the same position as the first neutralizer in an ejecting direction in which the liquid is ejected by the ejecting portion.

It is preferable that the mobile portion include a partition portion between the first neutralizer and the second neutralizer.

According to another aspect of the invention, a liquid ejecting method includes: an ejecting process for ejecting, to a medium being transported, liquid from an ejecting portion provided to a mobile portion that is movable in a crossing direction intersecting a transport direction of the medium; a first neutralizing process for neutralizing the liquid by using a first neutralizer provided to the mobile portion; and a second neutralizing process for neutralizing the medium by using a second neutralizer provided to the mobile portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

According to the invention, a simple configuration for neutralizing liquid ejected from an ejecting portion can be provided, and transport failure of a medium due to the neutralization of the liquid can be suppressed.

A recording apparatus according to one embodiment as a liquid ejecting apparatus of the invention will be described in detail below with reference to the drawings.

First Embodiment

FIG. 1 to FIG. 4

Figure 1:
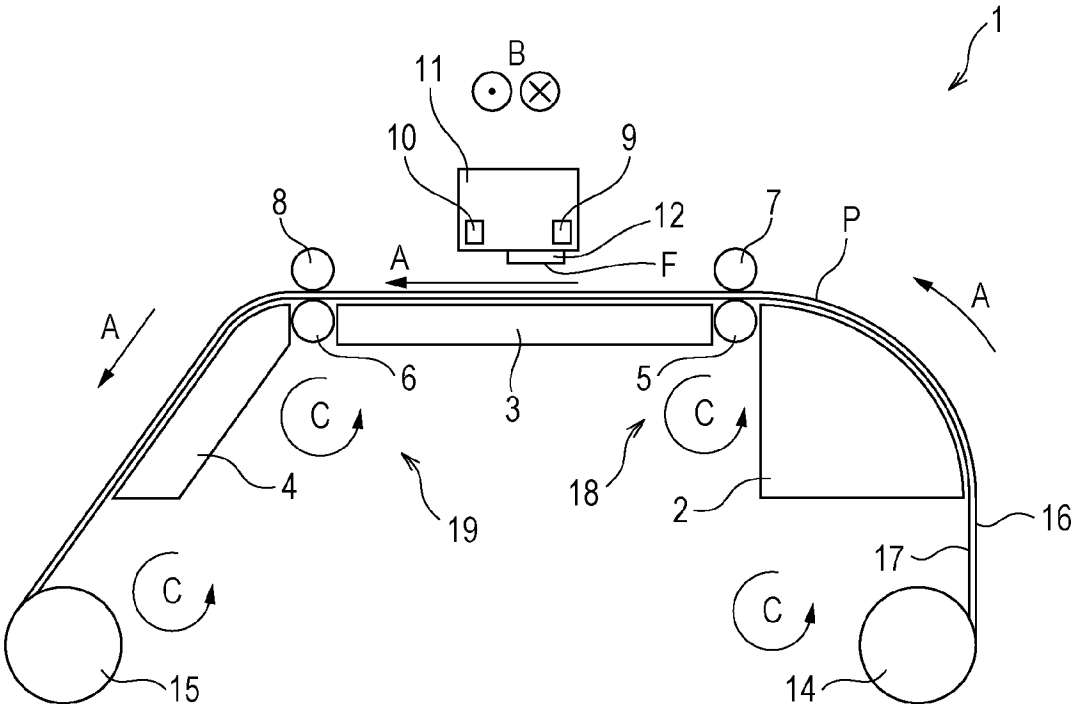
FIG. 1 is a schematic side view illustrating a recording apparatus according to a first embodiment of the invention.

FIG. 1 is a schematic side view illustrating a recording apparatus 1 according to a first embodiment of the invention.

The recording apparatus 1 of this embodiment transports a recording medium (a medium) P in a transport direction A from a setting unit 14, on which the recording medium P is set, to a winding unit 15, by which the recording medium P is wound, via a platen 2, a platen 3, and a platen 4, which are support portions for the recording medium P. That is, a section from the setting unit 14 to the winding unit 15 is a transport path for the recording medium P in the recording apparatus 1, and the platen 2, the platen 3, and the platen 4 are support portions for the recording medium P that is provided in the transport path. Note that the setting unit 14 is rotated in a rotation direction C so as to feed the recording medium P, and the winding unit 15 is rotated in the rotation direction C so as to wind up the recording medium P. Further, a heater may be arranged inside each of the platen 2, the platen 3, and the platen 4 so as to heat the recording medium P from the backside thereof.

Note that, while the recording apparatus 1 of this embodiment is configured to be able to perform recording on the roll-type recording medium P, without being limited to such a configuration, the recording apparatus 1 may be configured to be able to perform recording on a cut sheet recording medium P. When the recording apparatus 1 is configured to be able to perform recording on a cut sheet recording medium P, a so-called paper feeding (transport) tray, a paper feeding (transport) cassette, and the like may be used as the setting unit 14 for the recording medium P, for example. Further, as a collecting unit other than the winding unit 15 for the recording medium P, a so-called reception unit for ejection, a paper delivery (ejection) tray, a paper delivery (ejection) cassette, and the like may be used, for example.

Further, in this embodiment, since the roll-type recording medium P that has been wound such that a recording surface 16 of the recording medium P faces outward is used, the rotary shaft of the setting unit 14 is rotated in the rotation direction C when the recording medium P is fed from the setting unit 14. On the other hand, when the roll-type recording medium P that has been wound such that a recording surface 16 of the recording medium P faces inward is used, the rotary shaft of the setting unit 14 can be rotated in the opposite direction to the rotation direction C so as to feed the recording medium P.

Further, in a similar manner, since the winding unit 15 of this embodiment winds up the recording medium P such that the recording surface 16 faces outward, the rotary shaft of the winding unit 15 is rotated in the rotation direction C. On the other hand, when the recording medium P is wound such that the recording surface 16 faces inward, the rotation shaft of the winding unit 15 can be rotated in a direction opposite to the rotation direction C so as to wind the recording medium P.

Between the platen 2 and the platen 3 in the transport direction A of the recording medium P, the recording apparatus 1 of this embodiment has a transport roller unit 18 that has a pair of transport rollers including a driving roller 5 and a driven roller 7 that are driven and rotated in the rotation direction C. Note that, when the transport roller unit 18 transports the recording medium P, the driven roller 7 comes into contact with the recording surface 16 of the recording medium P, and the driving roller 5 comes into contact with a surface 17 opposite to the recording surface 16 of the recording medium P.

Further, downstream of the transport roller unit 18 in the transport direction A of the recording medium P, a recording head 12 as an ejecting portion that ejects ink (liquid) is provided in the side facing the platen 3. While reciprocating the recording head 12 provided to a carriage 11 moving as a mobile portion in a crossing direction B intersecting the transport direction A, the recording apparatus 1 causes the recording head 12 to eject ink onto the recording medium P from an ink ejecting face F of the recording head 12 to form a desired image.

The carriage 11 of this embodiment has a first neutralizer (ionizer) 9 that neutralizes ink. This configuration allows for neutralization of the ink ejected from the recording head 12.

Further, the carriage 11 of this embodiment has a second neutralizer 10 that neutralizes the recording medium P. This configuration suppresses a reduction in transportability due to the fact that the recording medium P is charged and attached to the platen 3 and the like.

Further, the configuration in which the carriage 11 is provided with the first neutralizer 9 and the second neutralizer 10 allows the ink ejected from the recording head 12 and the recording medium P to be neutralized in response to the motion of the carriage 11 in the crossing direction B. Such a configuration eliminates the need for a large, complicated configuration for the first neutralizer 9 and the second neutralizer 10. That is, a simple configuration of the first neutralizer 9 and the second neutralizer 10 is realized.

Therefore, a simple configuration for neutralizing the ink ejected from the recording head 12 is provided and transport failure of the recording medium P due to the neutralization of the ink is suppressed.

The first neutralizer 9 is preferably an ion generator for generating positive ions or negative ions. The second neutralizer 10 is preferably an ion generator for generating ions having the opposite polarity to the ions generated by the first neutralizer 9.

Note that, in the recording apparatus 1 of this embodiment, since the ink is likely to be charged in the positive polarity, the first neutralizer 9 is the ion generator for generating negative ions so as to be able to neutralize the ink charged in the positive polarity. The second neutralizer 10 is the ion generator for generating positive ions so as to be able to neutralize the recording medium P that is charged in the negative polarity due to the negative ions generated by the first neutralizer 9. When the ink which is likely to be charged in the negative polarity is used, however, a configuration in which the first neutralizer 9 generates positive ions and the second neutralizer 10 generates negative ions may be provided.

With such a configuration, the recording medium P that has been charged in one of the polarities due to the neutralization of the ink by the first neutralizer 9 can be effectively neutralized by applying ions having the other polarity by using the second neutralizer 10. That is, it is possible to suppress the attachment of the recording medium P by Coulomb force to the platen 3 and the like that are the support portions supporting the recording medium P.

Further, in the recording apparatus 1 of this embodiment, the first neutralizer 9 is provided upstream of the second neutralizer 10 in the transport direction A.

Therefore, even when the neutralization of the ink by the first neutralizer 9 causes the recording medium P to be supplied with negative ions and thereby the recording medium P is charged to the negative polarity by the first neutralizer 9, positive ions are then generated by the second neutralizer 10 and supplied to the recording medium P, so that the recording medium P can be effectively neutralized.

Note that a ventilator such as a fan may be provided in an appropriate position so that the ions generated by the first neutralizer 9 and the second neutralizer 10 can be effectively supplied to the ink and the recording medium P that are the objects to be neutralized.

Further, between the platen 3 and the platen 4 in the transport direction A of the recording medium P, the recording apparatus 1 of this embodiment has a transport roller unit 19 that has a pair of transport rollers including a driving roller 6 and a driven roller 8 that are driven and rotated in the rotation direction C. Note that, when the transport roller unit 19 transports the recording medium P, the driven roller 8 comes into contact with the recording surface 16 of the recording medium P, and the driving roller 6 comes into contact with the surface 17 opposite to the recording surface 16 of the recording medium P.

Note that the recording apparatus 1 of this embodiment has the transport units both upstream (transport roller unit 18) and downstream (the transport roller unit 19) of the recording head 12 in the transport direction A, which allows for a high accuracy in the transportation of the recording medium P that is located in a position facing the ink ejecting surface F. However, without being limited to the above, the transport unit may be provided upstream only of the recording head 12 in the transport direction A, or the transport unit may be provided downstream only of the recording head 12 in the transport direction A.

Next, the arrangement of the first neutralizer 9 and the second neutralizer 10 with respect to the carriage 11, which are the principal portions of the recording apparatus 1 of this embodiment, will be described.

Figure 2:
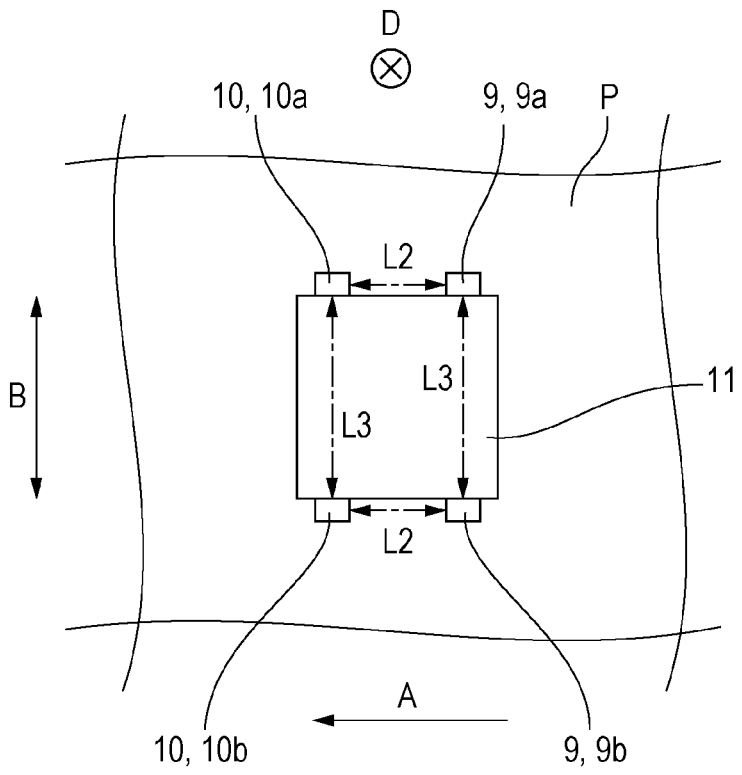
FIG. 2 is a schematic plan view illustrating a principal portion of the recording apparatus according to the first embodiment of the invention.
Figure 3:
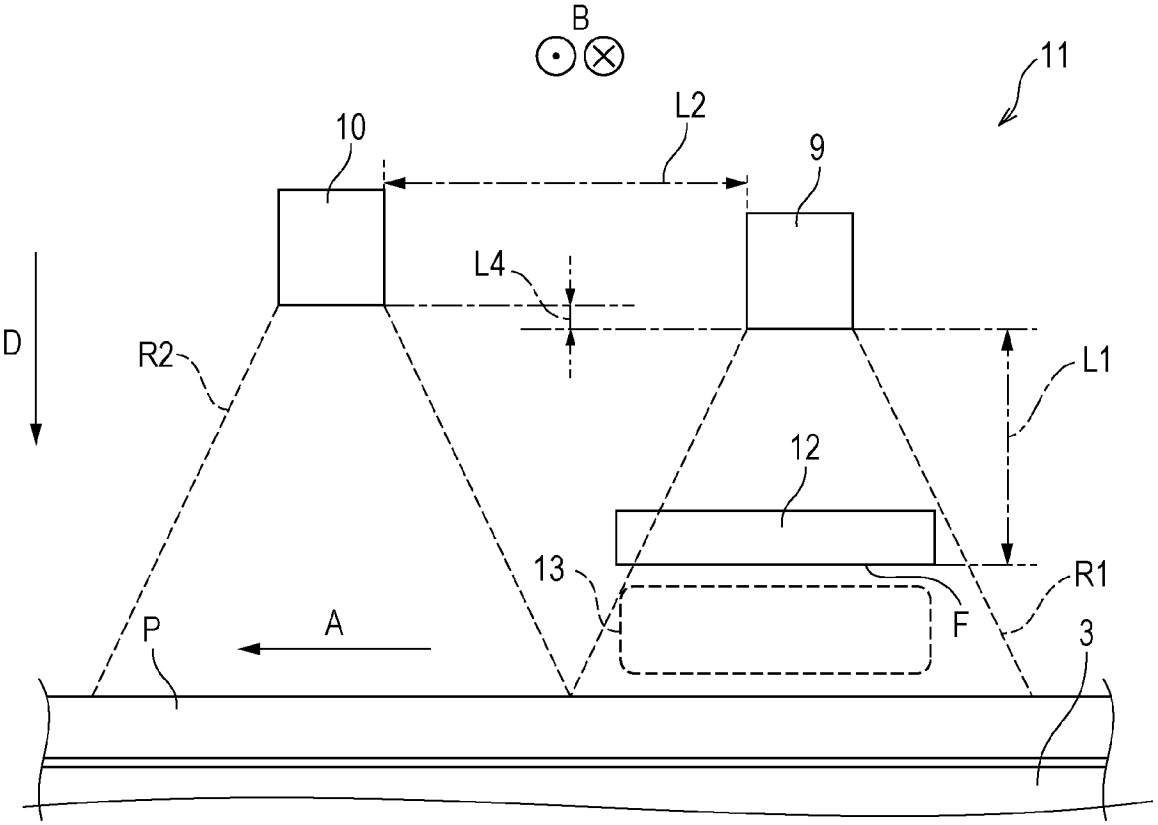
FIG. 3 is a schematic side view illustrating a principal portion of the recording apparatus according to the first embodiment of the invention.

FIG. 2 is a schematic plan view illustrating a principal portion of the recording apparatus 1 of this embodiment, and FIG. 3 is a schematic side view illustrating the principal portion of the recording apparatus 1 of this embodiment.

As illustrated in FIG. 2, the carriage 11 of this embodiment is provided with two first neutralizers 9, namely, first neutralizers 9*a* and 9*b* and two second neutralizers 10, namely, second neutralizers 10*a* and 10*b*. Here, the recording apparatus 1 of this embodiment is configured to be able to cause the recording head 12 to move in both the forward direction and the return direction and eject ink toward the recording medium P (perform recording on the recording medium P) during motion of the carriage 11 in the crossing direction B. Therefore, the first neutralizers 9*a* and 9*b* are provided on both sides of the carriage 11 in the crossing direction B. Thus, during the motion of the carriage 11 in both of the forward direction and the return direction in the crossing direction B, ink mist of the ink ejected from the recording head 12 can be effectively neutralized by causing the first neutralizer 9 which is located downstream of the recording head 12 in at least the motion direction to generate ions.

When ink is ejected from the recording head 12, ink mist occurs in response to the ejection of ink droplets other than ink droplets intended to land on the recording medium P (forming an image). The charged ink mist is likely to be selectively attached to portions such as the recording medium P, the components of the recording apparatus 1, and the like that are charged in the opposite polarity, and thereby likely to contaminate the recording medium P and the recording apparatus 1.

The recording apparatus 1 of this embodiment is able to effectively neutralize the ink mist in an ink mist generation area 13 illustrated in FIG. 3 by generating ions from the first neutralizer 9 located downstream of the recording head 12 in the crossing direction B. This effectively suppresses the contamination of the recording medium P and the recording apparatus 1. Further, with the configuration that allows for neutralization of not only the recording medium P but also the ink (ink mist), it is possible to suppress attachment of the charged ink mist to the ink ejecting surface F and the ink is retained on the ink ejecting surface F and then comes into contact with (for example, drops on) the recording medium P.

Further, in the recording apparatus 1 of this embodiment, a distance L2 between the first neutralizer 9 and the second neutralizer 10 is longer than or equal to 40 mm and shorter than or equal to 200 mm.

The distance L2 between the first neutralizer 9 and the second neutralizer 10 being 40 mm or longer can suppress a decrease in the neutralizing effect in a range that would otherwise be caused by an overlap of the effective ranges of the first neutralizer 9 and the second neutralizer 10 (a negative ion application range R1 by the first neutralizer 9 and a positive ion application range R2 by the second neutralizer 10). Further, the distance L2 between the first neutralizer 9 and the second neutralizer 10 being 200 mm or shorter can suppress a decrease in the effect of suppressing transport failure of the recording medium P due to the fact that it would otherwise take a longer time for the second neutralizer 10 to neutralize the recording medium P charged by the first neutralizer 9.

Note that, when the ion generators that generate ions having different polarities are used for the first neutralizer 9 and the second neutralizer 10 and the distance between them is too short, the ions having different polarities come into contact with each other before coming into contact with the object to be neutralized and thus the neutralizing effect decreases. For example, when the distance between the ion generators that generate ions having different polarities is less than or equal to about 25 mm, the neutralizing effect significantly decreases. In this case, it is difficult to neutralize the ink ejected from the recording head 12 and suppress transport failure of the recording medium P due to the neutralization of the ink.

Further, as illustrated in FIG. 3, in the recording apparatus 1 of this embodiment, the first neutralizer 9 is provided upstream of the recording head 12 within the range of 40 mm to 80 mm from the recording head 12 in an ejecting direction D in which the ink is ejected by the recording head 12.

Specifically, the position of the ion generator of the first neutralizer 9 is located upstream of the position of the ink ejecting surface F of the recording head 12 within the range of 40 mm to 80 mm from the ink ejecting surface F of the recording head 12 in the ejecting direction D of the ink. In other words, the position of the ion generator of the first neutralizer 9 is located upstream of the position of ink ejecting surface F by a distance L1 in the ejecting direction D of the ink.

Such a configuration allows the first neutralizer 9 to effectively neutralize the ink in the proper range R1 that is a range including the ink mist generation area 13, as illustrated in FIG. 3.

When the position of the ion generator of the first neutralizer 9 is located downstream or upstream by less than 40 mm of the position of the ink ejecting surface F of the recording head 12 in the ejecting direction D of the ink, neutralization may not be performed in the range that sufficiently includes the ink mist generation area 13. Further, when the position of the ion generator of the first neutralizer 9 is located upstream by more than 80 mm of the position of the ink ejecting surface F of the recording head 12 in the ejecting direction D of the ink, sufficient ions may not reach the ink mist generation area 13.

Further, as illustrated in FIG. 3, in the recording apparatus 1 of this embodiment, the second neutralizer 10 is preferably provided upstream of or at the same position as the first neutralizer 9 in the ejecting direction D of the ink.

Here, "the second neutralizer 10 is provided upstream of or at the same position as the first neutralizer 9 in the ejecting direction D of the ink" means that, in the ejecting direction D of the ink, the ion generator of the second neutralizer 10 is provided at the same position as or upstream of the ion generator of the first neutralizer 9.

In other words, a distance L4 from the position of the ion generator of the first neutralizer 9 to the position of the ion generator of the second neutralizer 10 in the direction toward the upstream region in the ejecting direction D of the ink is preferably greater than or equal to zero.

Such a configuration allows for neutralization in a wider range R2 of the recording medium P. Furthermore, it can suppress excessive charges from moving from the second neutralizer 10 to the recording medium P due to the excessively short distance between the second neutralizer 10 and the recording medium P and thus the recording medium P from being charged to the opposite polarity. Specifically, it can suppress excessive positive ions from being supplied to the recording medium P that has been charged in the negative polarity by the first neutralizer 9 and thus the recording medium P from being charged in the positive polarity.

Further, as illustrated in FIG. 2, a distance L3 between the first neutralizers 9*a* and 9*b* (a distance L3 between the second neutralizers 10*a* and 10*b*) being 40 mm or longer allows for a higher neutralizing effect when both of the first neutralizers 9*a* and 9*b* (the second neutralizers 10*a* and 10*b*) are driven at the same time. Therefore, the distance L3 between the first neutralizers 9*a* and 9*b* (the distance L3 between the second neutralizers 10*a* and 10*b*) is preferably longer than or equal to 40 mm.

Next, an electrical configuration of the recording apparatus 1 of this embodiment will be described.

Figure 4:
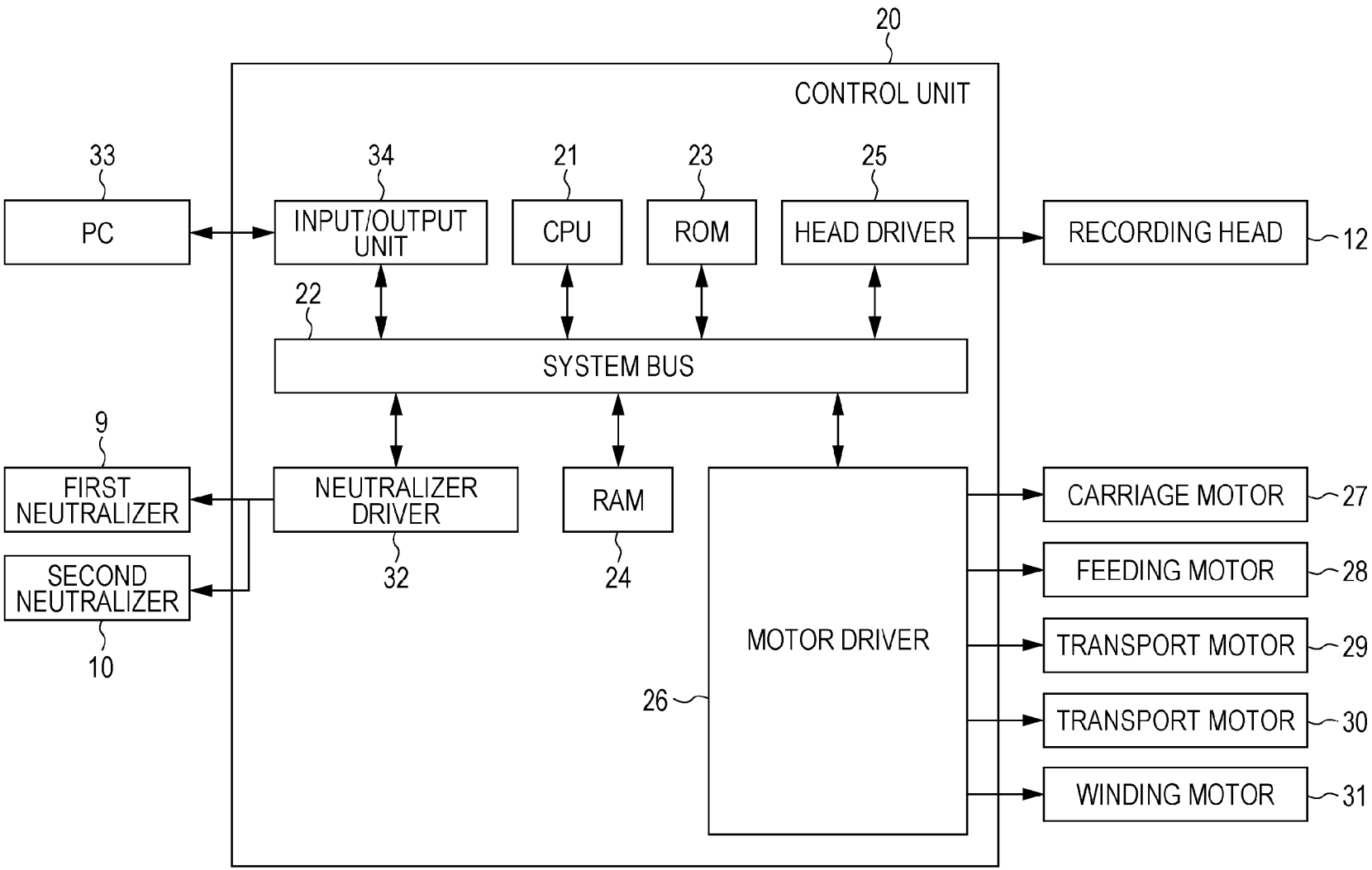
FIG. 4 is a block diagram of the recording apparatus according to the first embodiment of the invention.

FIG. 4 is a block diagram of the recording apparatus 1 of this embodiment.

A control unit 20 is provided with a CPU 21 that manages the entire control of the recording apparatus 1. CPU 21 is connected via a system bus 22 to a ROM 23 that stores various control programs, a maintenance sequence, and the like executed by the CPU 21, and to a RAM 24 that can temporarily store data.

Further, the CPU 21 is connected via the system bus 22 to a head driver 25 for driving the recording head 12.

Further, the CPU 21 is connected via the system bus 22 to a motor driver 26 for driving a carriage motor 27 that moves the carriage 11, a feeding motor 28 that is a driving source of the setting unit 14, a transport motor 29 that is a driving source of the driving roller 5, a transport motor 30 that is a driving source of the driving roller 6, and a winding motor 31 that is a driving source of the winding unit 15.

Further, the CPU 21 is connected via the system bus 22 to a neutralizer driver 32 for driving the first neutralizer 9 and the second neutralizer 10.

Furthermore, the CPU 21 is connected via the system bus 22 to an input/output unit 34 connected to a PC 33 that is an external device for inputting recording data and the like to the recording apparatus 1.

Second Embodiment

FIG. 5 and FIG. 6

Next, a recording apparatus of the second embodiment will be described in detail with reference to the drawings.

Figure 5:
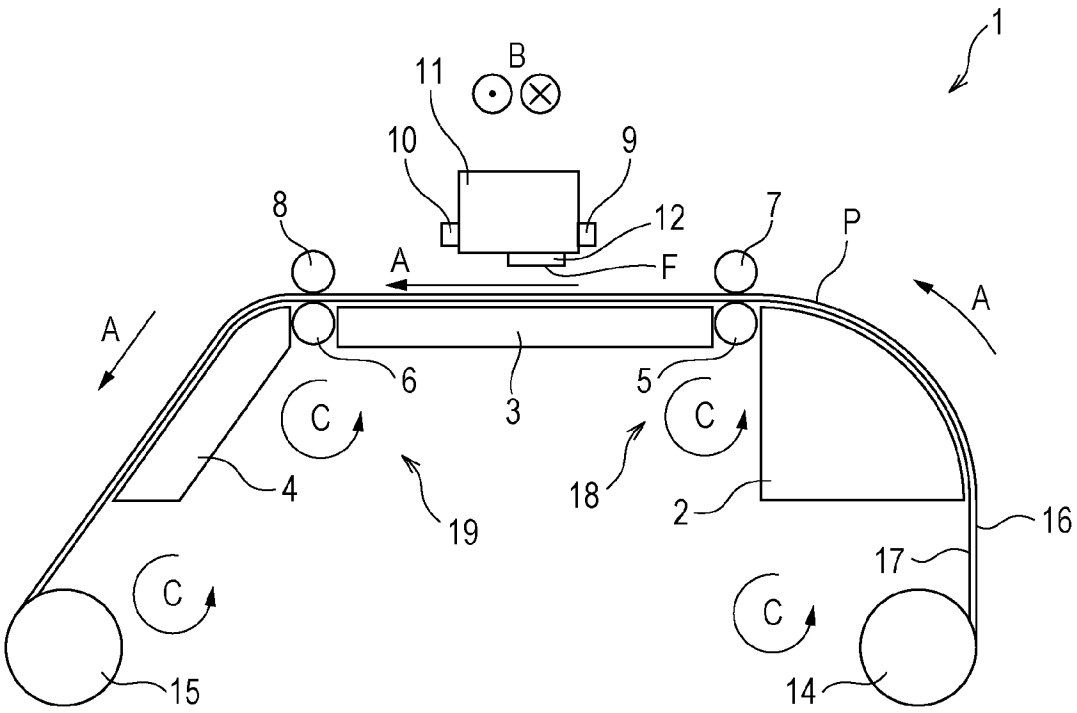
FIG. 5 is a schematic side view illustrating a recording apparatus according to a second embodiment of the invention.
Figure 6:
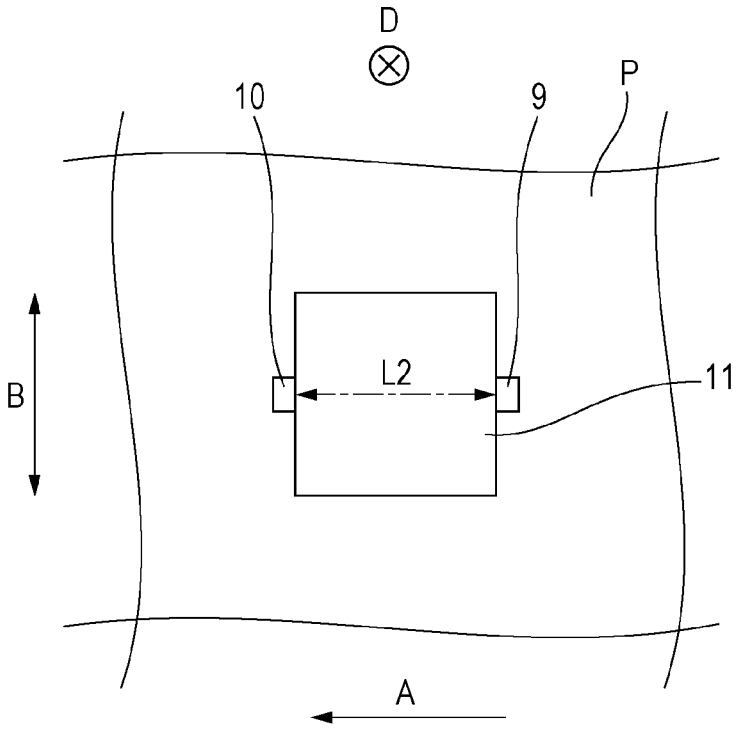
FIG. 6 is a schematic plan view illustrating a principal portion of the recording apparatus according to the second embodiment of the invention.

FIG. 5 is a schematic side view of a recording apparatus 1 of this embodiment. Further, FIG. 6 is a schematic plan view illustrating a principal portion of the recording apparatus 1 of this embodiment. Note that the same reference numbers are provided to the components common to the embodiment described above, and detailed description thereof will be omitted.

Note that the recording apparatus 1 of this embodiment is of the same configuration as the recording apparatus 1 of the first embodiment except the number and the arrangement of the first neutralizer 9 and the second neutralizer 10 provided to the carriage 11.

As illustrated in FIG. 5 and FIG. 6, the recording apparatus 1 of this embodiment has one first neutralizer 9 at the end in the upstream of the carriage 11 in the transport direction A and one second neutralizer 10 at the end in the downstream of the carriage 11 in the transport direction A.

Note that, in a similar manner to the recording apparatus of the first embodiment, the recording apparatus 1 of the recording apparatus 1 of this embodiment is able to cause the recording head 12 to move both forward direction and return direction and eject ink toward the recording medium P (perform recording on the recording medium P) in the motion of the carriage 11 in the crossing direction B. The configuration as illustrated in FIG. 5 and FIG. 6 allows for effective neutralization of ink mist of the ink ejected from the recording head 12 in response to the motion of the carriage 11 in both of the forward direction and the return direction in the crossing direction B. That is, because one first neutralizer 9 and one second neutralizer 10 only are provided, the effective neutralization of ink mist of the ink ejected from the recording head 12 is realized at a low cost.

Further, in a similar manner to the first embodiment, the distance L2 between the first neutralizer 9 and the second neutralizer 10 is longer than or equal to 40 mm and shorter than or equal to 200 mm in the recording apparatus 1 of this embodiment.

Here, "distance L2 between the first neutralizer 9 and the second neutralizer 10" refers to the distance between the ion generator of the first neutralizer 9 and the ion generator of the second neutralizer 10.

Thus, in a similar manner to the recording apparatus of the first embodiment, this embodiment suppresses a decrease in the neutralizing effect and also suppresses a decrease in the effect for suppressing transport failure of the recording medium P due to the fact that it would otherwise take longer time for the second neutralizer 10 to neutralize the recording medium P charged by the first neutralizer 9.

Third Embodiment

FIG. 7 and FIG. 8

Next, a recording apparatus of the third embodiment will be described in detail with reference to the drawings.

Figure 7:
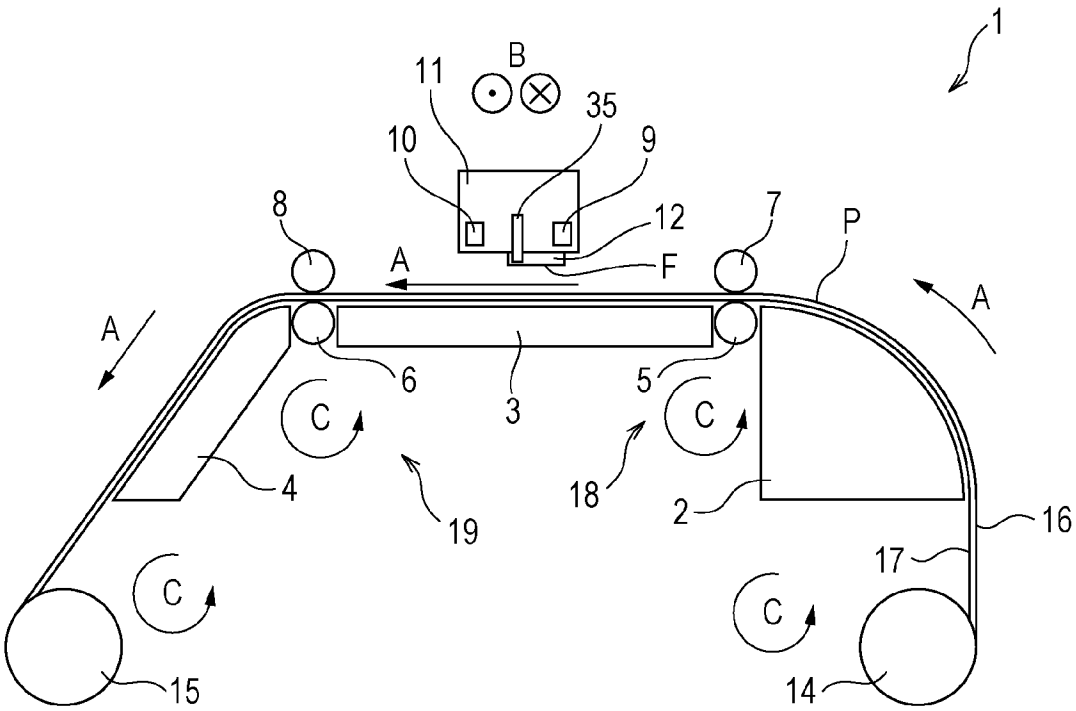
FIG. 7 a schematic side view illustrating a recording apparatus according to a third embodiment of the invention.
Figure 8:
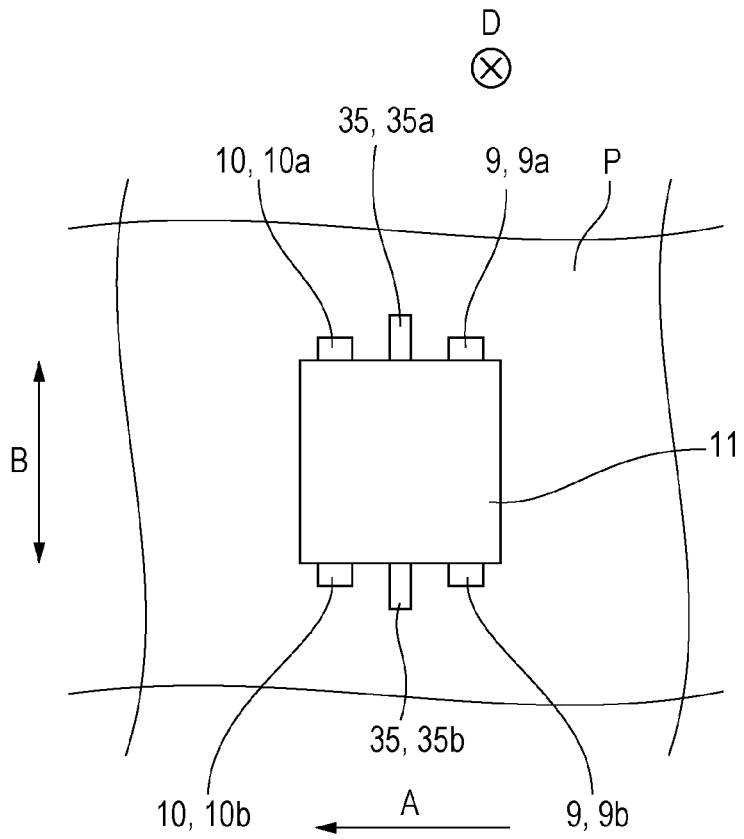
FIG. 8 is a schematic plan view illustrating a principal portion of the recording apparatus according to the third embodiment of the invention.

FIG. 7 is a schematic side view of a recording apparatus 1 of this embodiment. Further, FIG. 8 is a schematic plan view illustrating a principal portion of the recording apparatus 1 of this embodiment. Note that the same reference numbers are provided to the components common to the embodiment described above, and detailed description thereof will be omitted.

Note that the recording apparatus 1 of this embodiment is of the same configuration as the recording apparatus 1 of the first embodiment except that a partition portion 35 is provided between the first neutralizer 9 and the second neutralizer 10 in the carriage 11.

As illustrated in FIG. 7 and FIG. 8, the recording apparatus 1 of this embodiment has the partition portion 35 between the first neutralizer 9 and the second neutralizer 10 in the carriage 11. In details, as illustrated in FIG. 8, a partition portion 35*a* is provided between the first neutralizer 9*a* and the second neutralizer 10*a*, and a partition portion 35*b* is provided between the first neutralizer 9*b* and the second neutralizer 10*b*.

With such a configuration, the ions generated by the first neutralizer 9 and the ions generated by the second neutralizer 10 are partitioned by the partition portion 35 and thus less likely to come into contact with each other. That is, the recording apparatus 1 of this embodiment can suppress a decrease in the neutralizing effect due to the fact that the ions generated by the first neutralizer 9 and the ions generated by the second neutralizer 10 come into contact with each other before coming into contact with objects to be neutralized (the ink and the recording medium P). In other words, the recording apparatus 1 of this embodiment can suppress a decrease in the neutralizing effect due to an overlap of the effective ranges of the first neutralizer 9 and the second neutralizer 10. Embodiment of Liquid Ejecting Method, FIG. 9

Next, an embodiment of a liquid ejecting method (a recording method) using a recording apparatus 1 of the first embodiment will be described.

Figure 9:
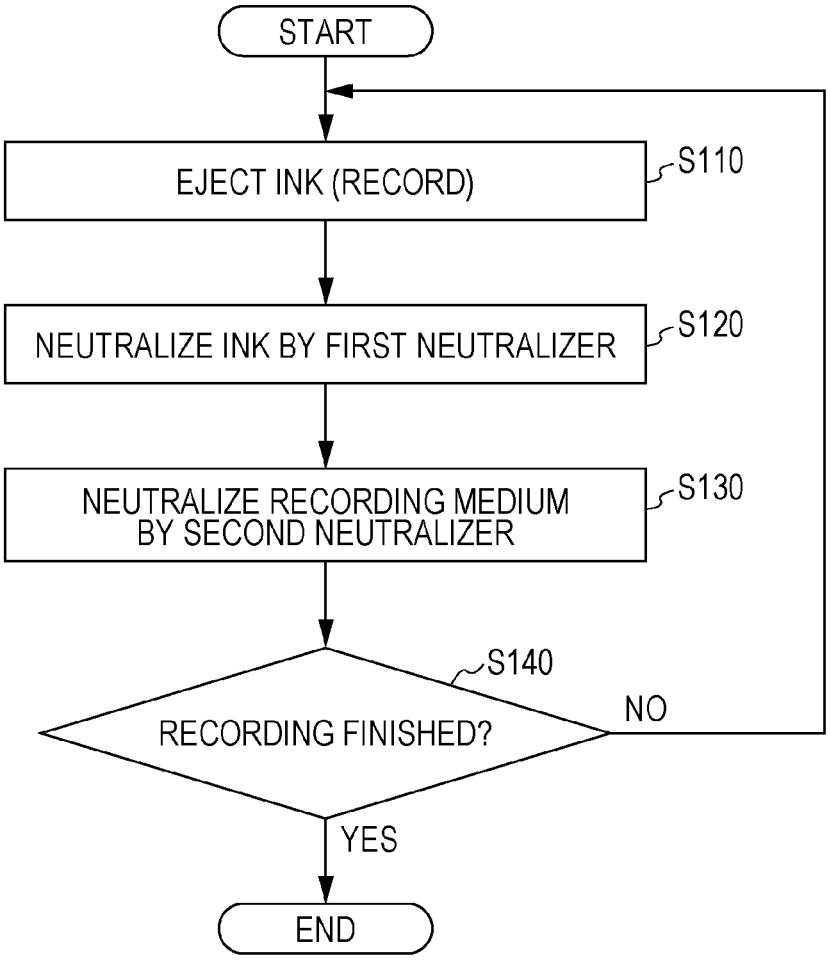
FIG. 9 is a flowchart of a liquid ejecting method according to one embodiment of the invention.

FIG. 9 is a flowchart of the liquid ejecting method of this embodiment.

Once the user sets the recording medium P on the recording apparatus 1 in a state as illustrated in FIG. 1 and the control unit 20 inputs, from the PC 33, recording data for performing recording on the recording medium P, in an ejecting process at step S110, the recording apparatus 1 of the first embodiment transports the recording medium P to a predetermined position and ejects ink (records) from the recording head 12. In details, ejection of the ink in one (one-way) motion of the reciprocation in the crossing direction B of the carriage 11 is performed.

Further, in a first neutralizing process at step S120, in response to one motion of the reciprocation of the carriage 11 in the crossing direction B in the ejecting process at step S110, the first neutralizer 9 generates negative ions to neutralize the ink (ink mist) ejected from the recording head 12. At this time, the ink is neutralized by the first neutralizer 9 which is located downstream of the recording head 12 in the motion direction of the carriage 11 in the crossing direction B. Note that the ink may be neutralized by the first neutralizer 9 which is located upstream of the recording head 12 in the motion direction of the carriage 11 in the crossing direction B, or may be neutralized by both the first neutralizers 9*a* and 9*b*.

Further, in a second neutralizing process at step S130, in response to one motion of the reciprocation of the carriage 11 in the crossing direction B in the ejecting process at step S110, the second neutralizer 10 generates positive ions to neutralize the recording medium P. In this step, neutralization is performed by supplying positive ions to the recording medium P that has been charged in the negative polarity due to attachment of the negative ions to the recording medium P at step S120.

Then, in a recording completion determination process at step S140, it is determined whether or not the recording based on the recording data is finished. Further, step S110 to step S140 are repeated until it is determined that the recording based on the recording data is finished, and the liquid ejecting method of this embodiment ends when it is determined that the recording based on the recording data is finished.

As described above, the liquid ejecting method of this embodiment has the first neutralizing process for neutralizing the liquid and thus allows for neutralizing the ink ejected from the recording head 12.

Further, the method has the second neutralizing process for neutralizing the recording medium P and thus can suppress a reduction in transportability due to attachment of the charged recording medium P to the platen 3 and the like.

Further, the first neutralizer 9 and the second neutralizer 10 are provided with the carriage 11, which eliminates the need for a large, complicated configuration for the first neutralizer 9 and the second neutralizer 10 and thus allows for a simple configuration.

Therefore, the liquid ejecting method of this embodiment can provide a simple configuration for neutralizing the ink ejected from the recording head 12 and suppress transport failure of the recording medium P due to the neutralization of the ink.

Note that the invention is not limited to the embodiments described above, but various modifications can be made within the scope of the claimed invention, which are of course included within the scope of the invention.

As described above, the invention has been described in detail based on the specific embodiments. The invention will now be summarized again.

The liquid ejecting apparatus 1 of the first aspect of the invention has: the transport units 18 and 19 that transport the medium P; the ejecting portion 12 that is provided to the mobile portion 11 that is movable in the crossing direction B intersecting the transport direction A in which the medium P is transported by the transport units 18 and 19, and ejects liquid onto the medium P transported by the transport units 18 and 19; the first neutralizer 9 that is provided to the mobile portion 11 and neutralizes the liquid; and the second neutralizer 10 that is provided to the mobile portion 11 and neutralizes the medium P.

According to this aspect, the first neutralizer 9 that neutralizes the liquid is provided. This allows for neutralization of the liquid ejected from the ejecting portion 12.

Further, the second neutralizer 10 that neutralizes the medium P is provided. This can suppress a reduction in transportability due to attachment of the charged medium P to the support portion 3 for the medium P.

Further, the first neutralizer 9 and the second neutralizer 10 are provided to the mobile portion 11. This eliminates the need for a large, complicated configuration for the first neutralizer 9 and the second neutralizer 10, and thus allows for a simple configuration.

Therefore, this aspect can provide a simple configuration for neutralizing the liquid ejected from the ejecting portion 12 and suppress transport failure of the medium P due to the neutralization of the liquid.

In the liquid ejecting apparatus 1 of the second aspect of the invention according to the first aspect, the first neutralizer 9 is an ion generator that generates positive ions or negative ions, and the second neutralizer 10 is an ion generator that generates ions having an opposite polarity to the ions generated by the first neutralizer 9.

According to this aspect, the first neutralizer 9 is the ion generator that generates positive ions or negative ions, and the second neutralizer 10 is the ion generator that generates ions having the opposite polarity to the ions generated by the first neutralizer 9. Thus, the medium P that has been charged in one of the polarities due to the neutralization of the liquid by the first neutralizer 9 can be effectively neutralized by applying the ions having the other polarity by using the second neutralizer 10. That is, it can be suppressed that the medium P is attached to the support portion for the medium P by Coulomb force.

In the liquid ejecting apparatus 1 of the third aspect of the invention according to the first or second aspect, the first neutralizer 9 is provided upstream of the second neutralizer 10 in the transport direction A of the medium P.

According to this aspect, the first neutralizer 9 is provided upstream of the second neutralizer 10 in the transport direction A of the medium P. Thus, even when the medium P is charged by the first neutralizer 9 due to the neutralization of the liquid by the first neutralizer 9, the medium P can be effectively neutralized by the second neutralizer 10.

In the liquid ejecting apparatus 1 of the fourth aspect of the invention according to any one of the first to third aspects, the distance L2 between the first neutralizer 9 and the second neutralizer 10 is longer than or equal to 40 mm and shorter than or equal to 200 mm.

Here, "distance L2 between the first neutralizer 9 and the second neutralizer 10" refers to the distance between the ion generator of the first neutralizer 9 and the ion generator of the second neutralizer 10.

According to this aspect, the distance between the first neutralizer 9 and the second neutralizer 10 is longer than or equal to 40 mm and shorter than or equal to 200 mm. This can suppress a decrease in the neutralizing effect in a range that would otherwise be caused by an overlap of the effective ranges of the first neutralizer 9 and the second neutralizer 10 (the neutralizing range R1 by the first neutralizer 9 and the neutralizing range R2 by the second neutralizer 10). Further, problems such as delay of the neutralization, by the second neutralizer 10, of the recording medium P charged by the first neutralizer 9 can be suppressed. That is, the liquid and the medium P can be effectively neutralized, respectively.

In the liquid ejecting apparatus 1 of the fifth aspect of the invention according to any one of the first to fourth aspects, the first neutralizer 9 is provided upstream of the ejecting portion 12 within a range of 40 mm to 80 mm from the ejecting portion 12 in the ejecting direction D in which the liquid is ejected by the ejecting portion 12.

Here, "the first neutralizer 9 is provided upstream of the ejecting portion 12 within the range of 40 mm to 80 mm from the ejecting portion 12 in the ejecting direction D in which the liquid is ejected by the ejecting portion 12" means that the ion generator of the first neutralizer 9 is provided upstream of the ink ejecting surface F of the ejecting portion 12 within the range of 40 mm to 80 mm from the ink ejecting surface F of the ejecting portion 12.

According to this aspect, the first neutralizer 9 is provided upstream of the ejecting portion 12 within the range of 40 mm to 80 mm from the ejecting portion 12 in the ejecting direction D in which the liquid is ejected by the ejecting portion 12. Thus, the first neutralizer 9 is able to effectively neutralize the liquid in the proper range.

In the liquid ejecting apparatus 1 of the sixth aspect of the invention according to any one of the first to fifth aspects, the second neutralizer 10 is provided upstream of or at the same position as the first neutralizer 9 in the ejecting direction D in which the liquid is ejected by the ejecting portion 12.

Here, "the second neutralizer 10 is provided upstream of or at the same position as the first neutralizer 9 in the ejecting direction D in which the liquid is ejected by the ejecting portion 12" means that, in the ejecting direction D of the liquid, the ion generator of the second neutralizer 10 is provided at the same position as or upstream of the ion generator of the first neutralizer 9.

According to this aspect, the second neutralizer 10 is provided upstream of or at the same position as the first neutralizer 9 in the ejecting direction D in which the liquid is ejected by the ejecting portion 12. That is, the second neutralizer 10 is provided in the same position as the first neutralizer 9 or upstream of the first neutralizer 9 in the ejecting direction D in which the liquid is ejected by the ejecting portion 12. This allows for neutralization of a wider range of the medium P and can suppress that the medium P is charged to the opposite polarity due to excessive charges moving from the second neutralizer 10 to the medium P.

In the liquid ejecting apparatus 1 of the seventh aspect of the invention according to any one of the first to sixth aspects, the mobile portion 11 has the partition portion 35 between the first neutralizer 9 and the second neutralizer 10.

According to this aspect, the mobile portion 11 has the partition portion 35 between the first neutralizer 9 and the second neutralizer 10. This can suppress an overlap of the effective ranges of the first neutralizer 9 and the second neutralizer 10 and therefore a decrease in the neutralizing effect in the ranges.

The eighth aspect of a liquid ejecting method of the invention includes: an ejecting process for ejecting, to a medium P being transported, liquid from the ejecting portion 12 provided to the mobile portion 11 that is movable in the crossing direction B intersecting the transport direction A of the medium P; a first neutralizing process for neutralizing the liquid by using the first neutralizer 9 provided to the mobile portion 11; and a second neutralizing process for neutralizing the medium P by using the second neutralizer 10 provided to the mobile portion 11.

According to this aspect, the first neutralizing process for neutralizing the liquid is provided. This allows for neutralization of the liquid ejected from the ejecting portion 12.

Further, the second neutralizing process for neutralizing the medium P is provided. This can suppress a reduction in transportability due to attachment of charged medium P to a support portion 3 for the medium P.

Further, providing the first neutralizer 9 and the second neutralizer 10 to the mobile portion 11 eliminates the need for a large, complicated configuration for the first neutralizer 9 and the second neutralizer 10, which allows for a simple configuration.

Therefore, this aspect allows for neutralizing the liquid ejected from the ejecting portion 12 by using a simple configuration and can suppress transport failure of the medium P due to the neutralization of the liquid.

The entire disclosure of Japanese Patent Application No. 2014-193417, filed Sep. 24, 2014 is expressly incorporated by reference herein.

What is claimed is:

1. A liquid ejecting apparatus comprising:

a transport unit that transports a medium in a transport direction;

an ejecting portion that is provided to a mobile portion that is movable in a crossing direction intersecting the transport direction in which the medium is transported by the transport unit, and ejects liquid onto the medium transported by the transport unit;

a first neutralizer that is provided to the mobile portion and neutralizes the liquid; and a second neutralizer that is provided on the mobile portion and neutralizes the medium, wherein the second neutralizer is downstream of the first neutralizer in the transport direction and wherein a distance between the first neutralizer and the second neutralizer is longer than or equal to 40 mm and shorter than or equal to 200 mm.

2. The liquid ejecting apparatus according to claim 1, wherein the first neutralizer is an ion generator that generates positive ions or negative ions, and the second neutralizer is an ion generator that generates ions having an opposite polarity to the ions generated by the first neutralizer.

3. The liquid ejecting apparatus according to claim 1, wherein the first neutralizer is provided upstream of the second neutralizer in the transport direction of the medium.

4. The liquid ejecting apparatus according to claim 1, wherein the first neutralizer is provided upstream of the ejecting portion within a range of 40 mm to 80 mm from the ejecting portion in an ejecting direction in which the liquid is ejected by the ejecting portion.

5. The liquid ejecting apparatus according to claim 1, wherein the second neutralizer is provided upstream of or at the same position as the first neutralizer in an ejecting direction in which the liquid is ejected by the ejecting portion.

6. The liquid ejecting apparatus according to claim 1, wherein the mobile portion includes a partition portion between the first neutralizer and the second neutralizer.

7. A liquid ejecting method comprising:

an ejecting process for ejecting, to a medium being transported, liquid from an ejecting portion provided to a mobile portion that is movable in a crossing direction intersecting a transport direction of the medium;

a first neutralizing process for neutralizing the liquid by using a first neutralizer provided on the mobile portion; and a second neutralizing process for neutralizing the medium by using a second neutralizer provided on the mobile portion, wherein the second neutralizer is downstream of the first neutralizer in the transport direction and wherein a distance between the first neutralizer and the second neutralizer is longer than or equal to 40 mm and shorter than or equal to 200 mm.

* * * * *